US005581279A

United States Patent [19]

Chang et al.

[11] Patent Number: 5,581,279

[45] Date of Patent: Dec. 3, 1996

[54] VGA CONTROLLER CIRCUITRY

[75] Inventors: Chieh Chang, Belmont; Man S. Lee, San Mateo; Alex Lushtak, Los Altos, all of Calif.

[73] Assignee: Cirrus Logic, Inc., Fremont, Calif.

[21] Appl. No.: 147,456

[22] Filed: Nov. 5, 1993

Related U.S. Application Data

[63] Continuation of Ser. No. 811,944, Dec. 23, 1991, abandoned.

[51] Int. Cl.[6] ..... G09G 5/36

[52] U.S. Cl. ..... 345/190; 395/507

[58] Field of Search ..... 345/132, 190, 345/201, 185; 395/325, 400, 164, 425; 357/45, 201; 257/203; 328/63, 104

[56] References Cited

U.S. PATENT DOCUMENTS

| | | | |
|---|---|---|---|
| 4,626,839 | 12/1986 | O'Malley . | |
| 4,633,441 | 12/1986 | Ishimoto | 365/189 |
| 4,727,363 | 2/1988 | Ishii . | |
| 4,811,007 | 3/1989 | Schreiber . | |
| 4,811,240 | 3/1989 | Ballou et al. . | |
| 4,851,892 | 7/1989 | Anderson et al. | 357/45 |
| 4,858,175 | 8/1989 | Sato | 257/203 |
| 4,894,646 | 1/1990 | Ryman | 345/201 |
| 4,918,436 | 4/1990 | Johary . | |
| 4,978,633 | 12/1990 | Seefeldt et al. | 257/203 |
| 5,036,216 | 7/1991 | Hohmann et al. . | |
| 5,039,884 | 8/1991 | Hara | 257/203 |
| 5,043,713 | 8/1991 | Katsura et al. . | |
| 5,063,429 | 11/1991 | Crafts | 257/203 |
| 5,095,280 | 3/1992 | Wunner et al. | 328/63 |
| 5,105,179 | 4/1992 | Smith | 340/815.01 |
| 5,345,554 | 9/1994 | Lippincott et al. | 345/164 |

FOREIGN PATENT DOCUMENTS

| | | | |
|---|---|---|---|
| WO/9115841 | 10/1991 | WIPO | 345/164 |
| WO91/15841 | 10/1991 | WIPO | 345/132 |

OTHER PUBLICATIONS

"PEGA2" User's Guide, pp. 2–61, 1986.
"Brooktree" pp. 1.2, (4.7)–(4.13) and (4.57)–(4.63), 1991.
"Brooktree" 1989.
"inmos" Nov. 1988.
Acumos VGA Video Controller AVGA1 data sheet, Sep. 6, 1990.

*Primary Examiner*—Ulysses Weldon
*Assistant Examiner*—Amare Mengistu
*Attorney, Agent, or Firm*—Lowe, Price, LeBlanc & Becker

[57] ABSTRACT

The "chip set" of a graphics adapter interface card is reduced to a monolithic integrated circuit that includes a programmable analog clock circuit for producing a video memory clock and a video dot clock. A digital graphics adapter controller is responsive to the video memory clock and the video dot clock to produce a video information stream. A random-access memory is responsive to the video information stream to produce a video display information stream, and a digital-to-analog converter is responsive to the video display information stream to convert the video display information stream to analog signals for application to a video display device.

11 Claims, 2 Drawing Sheets

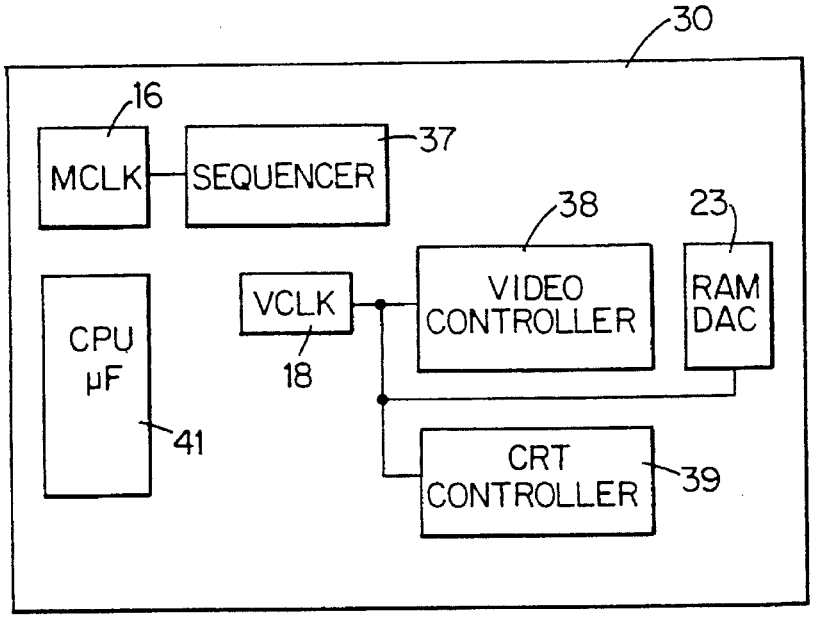
Fig. 3
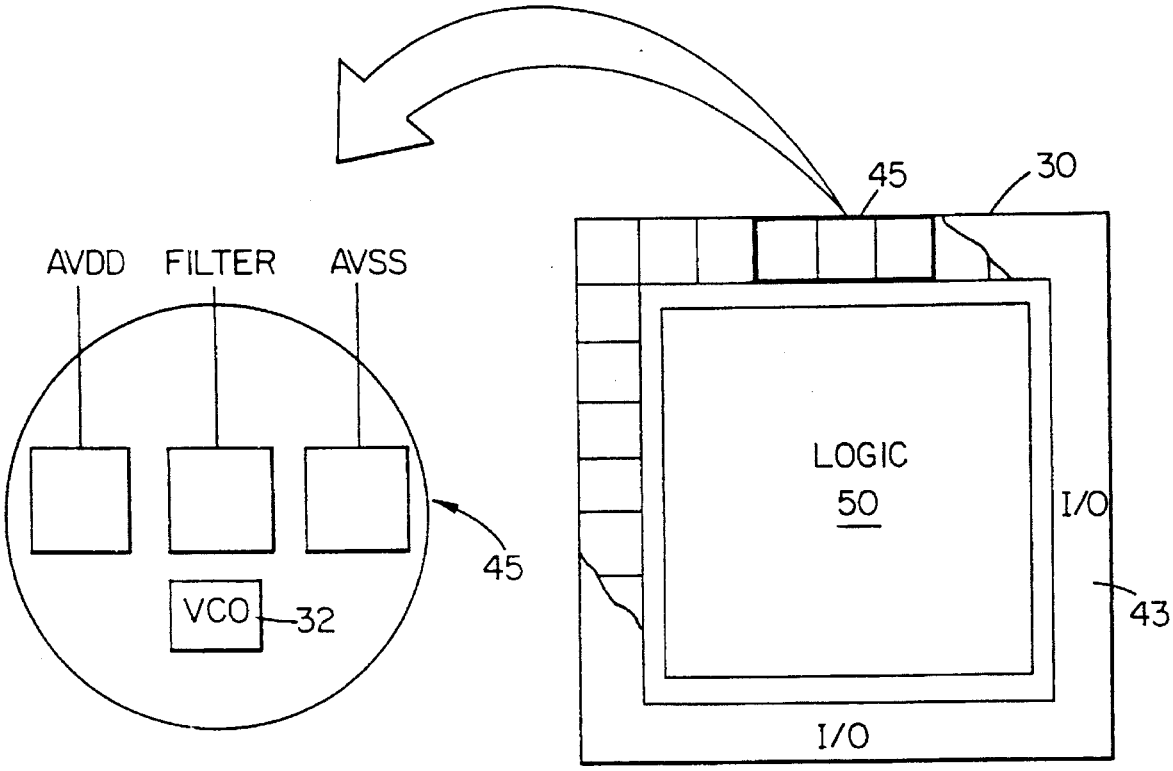
Fig. 4A
Fig. 4

VGA CONTROLLER CIRCUITRY

This application is a continuation of application Ser. No. 07/811,944, filed Dec. 23, 1991 now abandoned.

BACKGROUND OF THE INVENTION

1. Field of the Invention

The present invention relates to graphic display controllers and, more particularly, to integrated circuits that implement graphics display controllers and programmable clock signal generators.

2. State of the Art

In the field of computer graphics, the prevailing present-day standard is the VGA standard, which specifies a 640× 480 pixel display format. To implement that standard, conventional practice has been to use a VGA video interface card to interface a computer to a high-resolution display device. A VGA interface card is typically built around a VGA "chip set" that includes a number of complementary chips proven to work well together and that together realize all of the necessary functions to drive the display device. Reduction of the number of chips in the chip set simplifies manufacture, reduces cost and increases reliability.

In some VGA interface cards of the prior art, the chip set has included a programmable clock signal generator chip, or "P clock". An example of such a P clock chip is the Dual Video/Memory Clock Generator ICS90C64 manufactured by Integrated Circuit Systems, Inc. of Valley Forge Pa. A P clock chip simultaneously generates two clock signals. One clock signal is for the video memory used to store display information, and the other clock signal is used as the video dot clock signal, or pixel clock. Each cycle of the pixel clock, signals are produced to display one pixel on the display screen.

other than P clock chips, chips are also available to generate the video dot clock only, i.e. V clock chips. An example of one such chip may be found in U.S. Pat. No. 5,036,216, incorporated herein by reference. Clock chips of the type referred to are essentially frequency generators and are designed such that the frequency generated may be selected from among a set of predetermined frequencies that includes frequencies suitable for most common applications. The clock chips are therefore programmable in the narrow sense that their operating frequency can be selected. (The word "programmable" as it appears herein is used in the foregoing sense unless other indicated.)

The primary chip in a VGA chip set is typically a large, sophisticated, digital VGA controller chip manufactured using VLSI techniques. By contrast, P clock chips are comparatively small and are at least partly analog in order to perform the function of frequency generation. Therefore, despite the pressure to reduce chip count, the P clock chip and the VGA controller chip have been unlikely candidates for integration.

SUMMARY OF THE INVENTION

The present invention generally provides a "chip set" for a graphics adapter interface card where the chip set is effectively reduced to a single chip, or monolithic integrated circuit. The monolithic integrated circuit includes a programmable analog clock circuit for producing a video memory clock and a video dot clock. A digital graphics adapter controller is responsive to the video memory clock and the video dot clock to produce a video information stream. A random-access memory is responsive to the video information stream to produce a video display information stream, and a digital-to-analog converter is responsive to the video display information stream to convert the video display information stream to analog signals for application to a video display device. Precautions are taken to avoid interference of the digital signals of the digital graphics adapter controller with the analog signals of the programmable analog clock circuit.

BRIEF DESCRIPTION OF THE DRAWINGS

FIG. 3 is a functional block diagram showing, in greater detail, the VGA controller chip of the present invention; and FIGS. 4 and 4A are a plan diagram showing layout details of the VGA controller chip of the present invention.

DETAILED DESCRIPTION OF THE PREFERRED EMBODIMENTS

Figure 1:
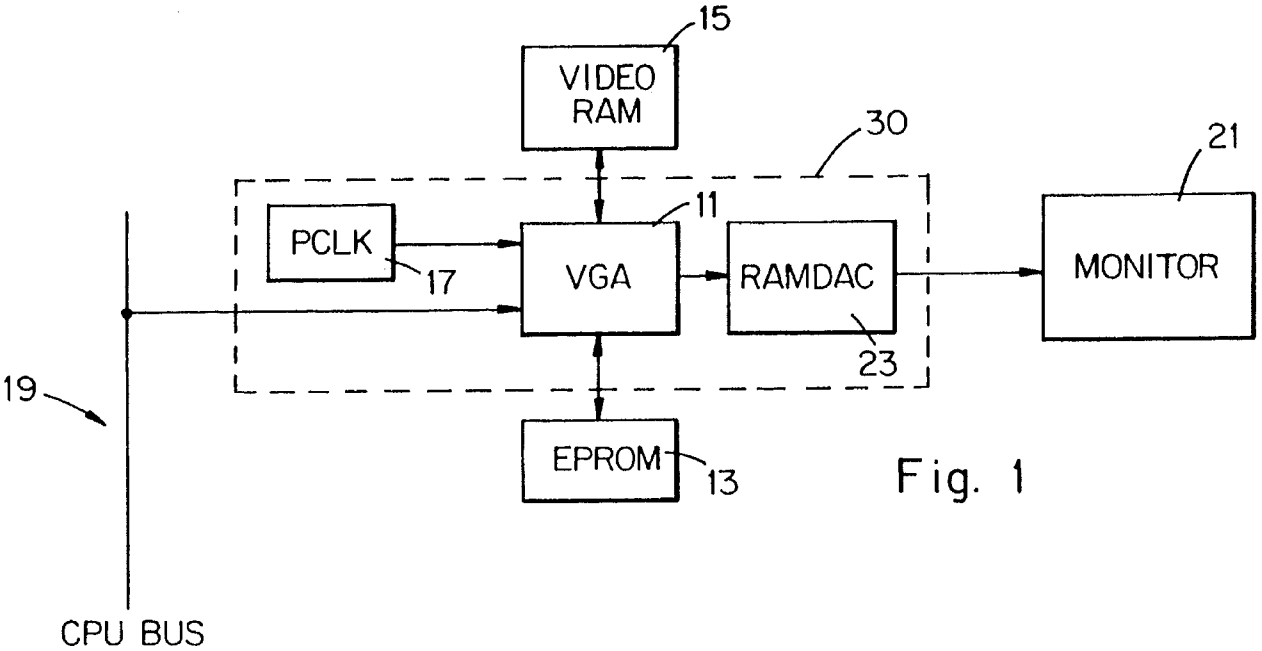
FIG. 1 is a functional block diagram of a VGA interface including the VGA controller chip of the present invention.

Referring now to FIG. 1, a VGA controller 11 operating according to program instructions stored in an EPROM 13 or other program memory reads and writes video information to and from a video RAM 15. Timing signals for the VGA controller 11 are provided by a P clock 17. The VGA controller 11 is connected to the CPU bus 19 such that the CPU may exercise supervisory control over the VGA controller 11. To display video information on a video monitor 21, the VGA controller 11 reads video information from the video RAM 15 and produces a video information stream that is output to a random access memory in combination with a digital-to-analog converter, together referred to as a RAMDAC. Using information stored in the RAM portion of the RAMDAC 23, the video information corresponding to each individual pixel is translated into video display information, for example the values of R, G and B signals required to display the pixel as desired. The R, G and B values are then converted to analog signals in the DAC portion of the RAMDAC 23, and output to the display monitor 21.

As will now be described, the VGA controller 11, the RAMDAC 23 and the P clock 17 are all integrated on a single hybrid integrated circuit chip 30. Integration of the VGA controller and the RAMDAC 23 has been achieved in the prior art. Since the VGA controller is exclusively digital, and the RAMDAC 23 is largely digital such an integration does not impose any inherent difficulties. The analog portion of the RAMDAC, namely the analog part of the digital-to-analog converter, produces only DC voltages, which are relatively immune to interference from digital signals. Digital-to-analog converters have of course been integrated for many years.

Despite the pressure to reduce chip count, however, the P clock and the VGA controller have been unlikely candidates for integration on a single chip. One formidable obstacle has been that the P clock necessarily includes high-frequency analog components that are easily susceptible to interference from digital signals. Furthermore, a VGA controller chip is large and complex and represents a significant research and development expenditure. A P clock is comparatively small. Because of the perceived incompatibility of the two devices for integration, conventional wisdom has been that to attempt to integrate the P clock and the VGA controller would be folly inasmuch as the small P clock with its analog circuitry would endanger operation of the large complex VGA controller.

The aforementioned reluctance to consider the P clock and the VGA controller as legitimate candidates for integration has obscured numerous significant advantages that can be achieved by a monolithic integration. A particular advantage of integrating the VGA controller 11, the RAMDAC 23 and the P clock 17 on a single chip (as shown in FIG. 1) is that true programmability of the P clock as opposed to mere frequency selectability may be greatly facilitated. The rate at which the VGA controller 11 reads video information from the video RAM 15 and the rate at which the VGA controller sends video information to the RAMDAC 23 may be different. Furthermore, these two rates may be required to vary widely according to the particular display requirements. The memory clock, or MCLK, according to which the VGA controller 11 accesses the video memory 15 may have a frequency ranging from 25 MHz to 50 MHz, for example, in typical applications. The video dot clock or VCLK, according to which the VGA controller 11 supplies video information the RAMDAC 23 may have a similar frequency range.

Figure 2:
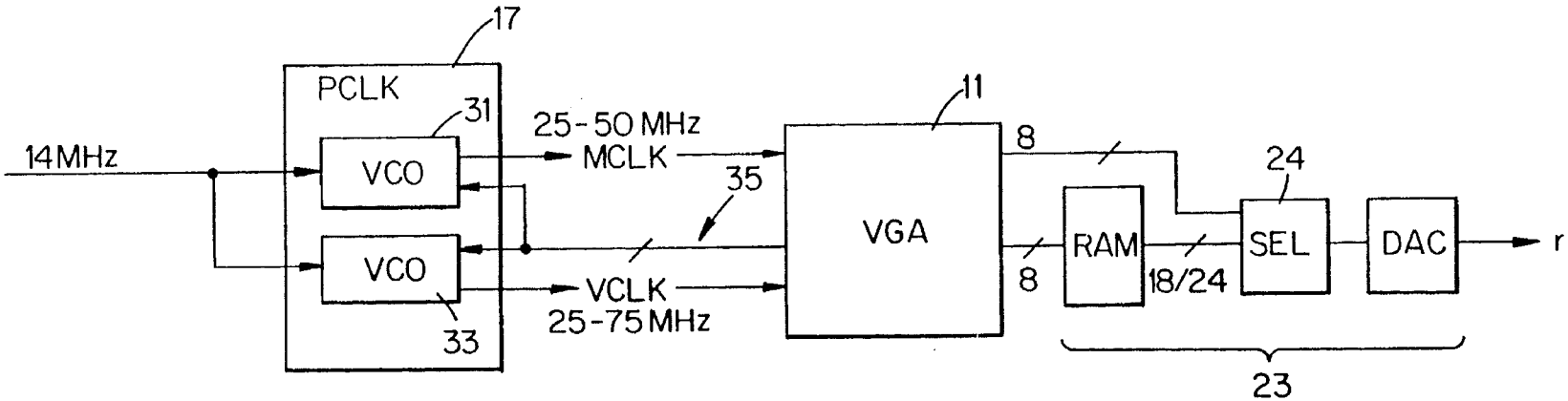
FIG. 2 is a functional block diagram showing in greater detail the P clock portion of the VGA controller chip of the present invention.

Referring to FIG. 2, the P clock generates the M clock and V clock using two analog voltage-controlled oscillators (VCOs) 31 and 33 each incorporated in a phase-locked loop. The phase-locked loops receive a reference frequency from the computer mother board, approximately 14 MHz in IBM-compatible computers. In accordance with the prior art, frequency selectability is achieved by incorporating variable dividers into the phase-locked loops. Pre-programmed devisors are loaded into the variable dividers according to frequency selection signals 35 from the VGA controller. To achieve true programmability, the devisors that may be used in the phase-locked loops would not be limited to some number of pre-programmed devisors but would instead be arbitrarily specified by the VGA controller to some precision within a wide allowable range. As different graphical standards and formats evolve, the system would then be adapted by simply changing the program of the VGA controller 11 stored in the EPROM 13.

True programmability, however, requires a considerably more complex interface between the VGA controller 11 and the P clock 17 than simple frequency selectability, requiring in turn an increased number of signal lines between the two devices. By integrating the P clock 17 and the VGA controller 11 on a single chip, the signals necessary to achieve true programmability may be placed on chip. With the P clock and the VGA controller on separate chips, the alternative would be to attempt to increase the already-large pin count of the VGA controller chip to make additional signal lines available, a dubious undertaking at best.

By integrating the P clock 17 and the VGA controller 11 such that the interface signal lines between the two devices are placed on chip, further advantages are achieved. Less power is required to drive the signal lines (an important consideration in notebook applications) and less electromagnetic radiation is produced, making F.C.C. approval easier. With the two devices on separate chips, powerful signal drivers must be provided to drive signals between the two chips along traces on a printed circuit board, increasing radiation and the precautions necessary to achieve F.C.C. compliance. With the P clock 17 and the VGA controller 11 on the same chip, radiation levels may be sufficiently reduced to allow a two layer printed circuit board to be used rather than a four layer printed circuit board.

Significant advantages are also achieved by integrating on a single chip with the VGA controller 11 not only the P clock 17 but also the RAMDAC 23. In certain modes of operation, it may be desirable for the VGA controller 11 to bypass the RAM portion of the RAMDAC 23 and instead provide video display information directly to the DAC portion of the RAMDAC 23 through a selector 24. In order to support 18/24 bit color mode, if the RAMDAC 23 were not integrated with the VGA controller 11, 24 additional output pins would have to be provided on the VGA controller chip, which would render the VGA controller chip economically unfeasible. By integrating the VGA controller and the RAMDAC 23, corresponding signal lines may be run on chip such that 18/24 bit color mode may be supported with no pin count penalty.

As shown in FIG. 3, the RAMDAC 23 is integrated on-chip. In addition, the P clock, composed of an MCLK portion 16 and a VCLK portion 18, is integrated on-chip. The MCLK block 16 supplies an M clock to a sequencer 27 that controls reading and writing to and from the video memory. The VCLK block 18 supplies a V clock or video dot clock to a CRT controller 38, a video controller 39, and the RAMDAC 23. The CRT controller contains various counters such as a line counter, a pixel counter, and a frame counter together with associated logic for controlling the actual video display of information. The video controller 39 formats memory data (according to selected display modes) and sends the video data to the RAMDAC. A CPU interface 41 allows the host computer to exercise supervisory control.

As mentioned previously, potential interference of the VGA controller's digital signals with the analog signals of the P clock poses a distinct threat to circuit performance. This threat may be negated using strategic design measures as illustrated in FIG. 4. In addition to digital power and ground signals VDD and VSS, analog power and ground signals AVDD and AVSS are separately provided. A logic portion 50 of the VGA controller chip 30 occupies an interior region of the chip, and I/O cells 43 including analog and digital I/O cells, are provided around the periphery of the chip (the wafer substrate) to allow for input of external signals to the chip 30 and output of internal signals from the chip.

Another important feature of the above-described monolithic integration is that the analog I/O cells are at least partially grouped together and the voltage controlled oscillators of the P clock (31 and 33 in FIG. 2) are formed at least partially within an analog I/O cell located in between two other analog I/O cells. This situation is depicted in the enlarged area FIG. 4, representing a magnified view of a portion of three adjacent analog I/O cells 45. Seen in the magnified area are three I/O pads to which signal pins are to be bonded, an AVDD pad, a FILTER pad and an AVSS pad. AVCO portion 32 of one of the MCLK and the VCLK is laid out in an area of the chip adjacent the FILTER pad, in between the AVDD and AVSS pads. The VCO portion 32 of the clock is therefore located apart from a digital portion of the clock and close to the FILTER signal required by the VCO 32. Furthermore, the next closest inputs, AVDD and AVSS, are both stable DC inputs, which do not cause interference for the high-frequency VCO. The other VCO is similarly located adjacent its corresponding FILTER input and is flanked by separate AVDD and AVSS pads.

Therefore, the above-described monolithic integration provides a complete VGA solution in the form of a fully-integrated VGA controller chip. By integrating both the RAMDAC 23 and the P clock on-chip, total pin count may be significantly reduced. Radiation levels may also be significantly reduced, making board design and regulatory approval much easier. Most significant, integration of the VGA controller and the P clock renders the prospect of true programmability of the P clock technically feasible.

The foregoing has described the principles, preferred embodiments and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of present invention as defined by the following claims.

What is claimed is:

1. A monolithic integrated circuit comprising:

programmable clock circuit means for producing a video memory clock signal and a video dot clock signal;

a video controller coupled to said programmable clock circuit means for receiving the video memory clock signal and the video dot clock signal and for producing a video information data stream;

random-access memory means, coupled to said video controller, for receiving the video information data stream and producing a video display information data stream; and digital-to-analog converter means, coupled to both said random-access memory and to said video controller, for selectively receiving either the video information data stream or the video display information data stream as received data and for converting the received data to analog video signals.

2. The monolithic integrated circuit of claim 1, wherein said video information data stream comprises a stream of pixel data having twenty-four bits per pixel and said digital-to-analog converter means comprises three digital to analog converters.

3. The monolithic integrated circuit of claim 1, wherein said video information data stream comprises a stream of pixel data having eighteen bits per pixel and said digital-to-analog converter means comprises three digital to analog converters each for receiving six data bits.

4. The monolithic integrated circuit of claim 1, wherein said video information data stream comprises a stream of pixel data having at least eight data bits per pixel.

5. An arrangement comprising:

a monolithic integrated circuit having:

programmable clock circuit means for receiving a reference clock signal and devisor data and for dividing said reference clock signal by said devisor data to produce a video memory clock signal and a video dot clock signal;

a video controller coupled to said programmable clock circuit for providing said programmable clock circuit means with said devisor data and for receiving the video memory clock signal and the video dot clock signal and for producing a video information data stream;

random-access memory means, coupled to said video controller, for receiving the video information data stream and producing a video display information data stream;

digital-to-analog converter means, coupled to said random-access memory means, for receiving the video information data stream and converting the video information data stream to analog video signals; and programmable memory means coupled to the monolithic integrated circuit for storing said devisor data to be received by the programmable clock circuit means.

6. The arrangement of claim 5, wherein the video memory clock has a frequency selected from among 37.58523 MHz, 41.74431 MHz, and 50.11363 MHz.

7. The arrangement of claim 5, wherein the video dot clock signal has a frequency selected from among 25.1802 MHz, 28.3251 MHz, 41.1648 MHz. 36.0818 MHz, 31.193 MHz, 39.992 MHz, 44.907 MHz, 50.113 MHz, 64.982 MHz, and 75.169 MHz.

8. The arrangement of claim 5, wherein said programmable memory means may be selectively programmed with devisor data so as to selectively alter the frequency of said video memory clock signal and said video dot clock signal.

9. A monolithic integrated circuit comprising:

a programmable clock circuit responsive to a reference clock signal and devisor data and generating a video memory clock signal and a video dot clock signal;

a video controller receiving the video memory clock signal and the video dot clock signal and producing a video information data stream from data received from a video RAM;

a random-access memory producing a video display information data stream in response to the video information data stream from said video controller;

a digital-to-analog converter converting received digital data to analog video signals; and a selector supplying one of said video information data stream from the video controller and said video display information data stream from said random-access memory to said digital-to-analog converter as said received digital data.

10. A circuit as recited in claim 9, wherein the devisor data is supplied to said programmable clock circuit from the video controller.

11. A circuit as recited in claim 10, wherein the video controller supplies the devisor data in response to program instructions retrieved from a programmable memory.

* * * * *

UNITED STATES PATENT AND TRADEMARK OFFICE

CERTIFICATE OF CORRECTION

PATENT NO. : 5,581,279

DATED : December 3, 1996

INVENTOR(S) : Chang et al.

It is certified that error appears in the above-indentified patent and that said Letters Patent is hereby corrected as shown below:

Column 1, line 37, delete "other" and insert --Other--.

Column 4, line 19, delete "CRT controller 38, a video controller 39" and insert --CRT controller 39, a video controller 38--.

Column 4, line 24, delete "video controller 39" and insert --video controller 38--.

Signed and Sealed this

Nineteenth Day of August, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,581,279

DATED : December 3, 1996

INVENTOR(S) : Chang et al.

It is certified that error appears in the above-identified patent and that said Letters Patent is hereby corrected as shown below:

Column 6, line 9, after "video" insert --display--; and
line 10, after "video" insert --display--.

Signed and Sealed this

Twenty-fifth Day of May, 1999

*Attest:*

Q. TODD DICKINSON

*Attesting Officer*

*Acting Commissioner of Patents and Trademarks*